US005563369A

United States Patent [19]

Yazawa et al.

[11] Patent Number: 5,563,369

[45] Date of Patent: Oct. 8, 1996

[54] CURRENT LEAD

[75] Inventors: Takashi Yazawa, Yokohama; Satoshi Yasuda, Kawasaki, both of Japan

[73] Assignee: Kabushiki Kaisha Toshiba, Kawasaki, Japan

[21] Appl. No.: 180,800

[22] Filed: Jan. 10, 1994

Related U.S. Application Data

[63] Continuation of Ser. No. 719,012, Jun. 21, 1991, abandoned.

[30] Foreign Application Priority Data

Jun. 22, 1990 [JP] Japan ..... 2-162711
Jan. 18, 1991 [JP] Japan ..... 3-004429

[51] Int. Cl.[6] ..... H01B 12/00; H01F 6/00

[52] U.S. Cl. ..... 174/15.4; 62/51.1; 505/885; 505/900; 335/216

[58] Field of Search ..... 174/15.1, 15.4, 174/15.5; 505/885, 899, 900, 892, 891; 62/51.1, 47.1; 335/216

[56] References Cited

U.S. PATENT DOCUMENTS 2,064,184 12/1936 Stevens ..... 174/126.1
3,278,808 10/1966 Bonfeld ..... 174/15.4 X
3,371,145 2/1968 Camille, Jr. ..... 505/885 X
3,849,589 11/1974 Schmidt et al. ..... 505/885 X
4,091,298 5/1978 Gamble ..... 310/52

FOREIGN PATENT DOCUMENTS 0285147 10/1988 European Pat. Off. .
2451949 5/1976 Germany .

OTHER PUBLICATIONS

Magnet Technology II, pp. 1381–1386, Aug. 28, 1989, T. Yazawa, et al., "Current Leads Design Considering Unsteady State".

*Primary Examiner*—Hyung S. Sough
*Attorney, Agent, or Firm*—Oblon, Spivak, McClelland, Maier & Neustadt, P.C.

[57] ABSTRACT

A superconducting magnet is arranged in a helium tank, and the superconducting magnet cooled to a very low temperature by liquid helium in the helium tank is connected to a power source kept at room temperature by a current lead and a current lead. The current leads are constituted by conductors made of copper or a copper alloy having a residual resistivity of $5\times10^{-8}$ Ω·m or more. In a helium tank, a persistent current switch, cooled by liquid helium, for connecting the conductor to the conductor, is arranged. The persistent current switch magnetizes the superconducting magnet to a persistent current mode and demagnetizes it from the persistent current mode. The helium tank is arranged in a vacuum housing.

11 Claims, 9 Drawing Sheets

CURRENT LEAD

This application is a Continuation of application Ser. No. 07/719,012, filed on Jun. 21, 1991, now abandoned.

BACKGROUND OF THE INVENTION

1. Field of the Invention

The present invention relates to a current lead for electrically connecting a superconducting magnet cooled to a very low temperature to a power supply kept at room temperature.

2. Description of the Related Art

The most important feature of superconductivity is that a large current can flow without any loss. A representative application of superconductivity is a superconducting magnet in a persistent current mode. The superconducting magnet requires current leads for supplying a current from a power supply kept at room temperature to the superconducting magnet kept at very low temperature by liquid helium. Only when the super-conducting magnet is magnetized to a persistent current mode and demagnetized from the persistent current mode, a current flows in the current leads. Therefore, if magnetization and demagnetization are performed once a day, a period for supplying a current to the current lead is several minutes to one hour a day, and the current is not supplied to the current leads for a large part of a day. Since heat is transmitted from a high-temperature side to a very-low-temperature side through the current leads by its thermal conduction in an ON time, the current leads serves as a thermal load to the low temperature end.

In order to reduce the thermal load and effectively drive a superconducting magnet in a persistent current mode, the following two methods are employed.

According to the first method, current leads are formed to be demountable, and the current lead is detached in an OFF time. With this method, an amount of thermal conduction from the current lead in an OFF time can be largely reduced.

According to the second method, stability of the current leads in an ON time is considered. The dimension of the current lead is planned so that a thermal load to very low temperature is minimized in consideration of the current lead in an OFF time. At the same time, the current leads are cooled so that an increase in temperature of the current lead falls within a stable range in an ON time. That is, since an amount of thermal penetration in an OFF time is in proportion to A/L (A: sectional area, L: overall length) of the current lead, the dimension of the current lead is planned so that the value of A/L is minimized. In addition, a current lead conductor is arranged in a cooling tube, and cooling gas is forcibly circulated in the tube to cool the current lead in an ON time. This method is effectively used in a case wherein a superconducting magnet is frequently magnetized to a persistent current mode and demagnetized from the persistent current mode.

In the former method, impurity gas is possibly supplied to a connecting portion between the current lead and the superconducting magnet. When the impurity gas is supplied to the portion, reliability of the operation of the current lead is degraded. Further, when the current lead is detached, the superconducting magnet may not be forcibly demagnetized in a state of emergency. For this reason, this method cannot be employed to all systems.

In the latter method, cumbersome operations such as opening/closing operations of a valve of a tube for circulating a cooling gas, and an ON/OFF operation of a heater for circulating forcibly cooling gas must be performed. Therefore, this method cannot respond to a demand for simplifying magnetizing and demagnetizing operations.

On the other hand, in current leads, in order to reduce an amount of thermal penetration to a very-low-temperature portion, a structure in which a liquid nitrogen anchor portion is arranged midway along a path from a room-temperature portion to the very-low-temperature portion is often employed. This method is effectively used for gas cooling type current leads for cooling a conductor by helium gas obtained by evaporating liquid helium for cooling a superconducting magnet. More particularly, the method is effectively used for reducing the amount of thermal penetration of current leads in which helium gas does not flow in an OFF time. FIG. 1 is a schematic view showing a conventional gas cooling type current lead having the liquid nitrogen anchor. Referring to FIG. 1, a current lead 1 has a cooling tube 2, a conductor 3 formed in the cooling tube 2, and a liquid nitrogen anchor portion 5. A cooling helium gas path 4 is formed between the conductor 3 and the cooling tube 2, and helium vapor is circulated in the path 4 to cool the conductor 3. In the liquid nitrogen anchor portion 5, a liquid nitrogen tube 7 is connected to the conductor 3 through an electric insulator 6, and the conductor 3 is cooled by liquid nitrogen circulated in the tube 7. The A and B sides of a main body 1 are connected to a room-temperature portion and a very-low-temperature portion, respectively, and the cooling helium flows in the path 3 from the B side to the A side.

However, the above current lead has the following problem. That is, cooling helium gas evaporated from a liquid helium tank on the very-low-temperature side exchanges heat with the current lead which generates heat, and the temperature of the helium gas is increased from 4.2 K. When the helium gas reaches the liquid nitrogen anchor portion 5, the temperature of the helium gas may be lower than the freezing point of nitrogen of 63.3 K (at 1 atmospheric pressure). In this case, liquid nitrogen is frozen in the tube 7 to clog the liquid nitrogen tube 7, thereby largely degrading reliability of the current lead.

As a means for solving the above problem, as shown in FIG. 2, a method in which a thermal switch 8 is arranged to the liquid nitrogen anchor portion 5 is proposed. Since the thermal switch 8 is turned on at a temperature of 77 K or more and turned off at the temperature of less than 77 K, when helium gas having a temperature of less than 66.3 K flows, the liquid nitrogen is not frozen because the liquid nitrogen tube 7 is thermally insulated from the main body 1 of the current lead.

In the above technique, however, the structure of the current lead is complicated and large in size. In addition, when a gravity heat pipe described in a paper of the Advance Cryogenic Engineering Vol. 29 (1984) p. 658 by J. Yamamoto is used as the thermal switch, a location in use of a current lead is restricted due to the gravity dependency of the gravity heat pipe.

SUMMARY OF THE INVENTION

The present invention has been made in consideration of the above problem, and has as its object to provide a current lead in which thermal penetration to a very-low-temperature portion can be effectively reduced without requiring a cumbersome operation and degrading reliability of the operation of the current lead and which has high-temperature stability in an ON time.

It is another object of the present invention to provide a current lead in which liquid nitrogen is not frozen, and a structure and a location in use are not restricted.

According to an aspect of the present invention, there is provided a current lead, for electrically connecting a superconducting device cooled to a low temperature to a power supply kept at room temperature, comprising a conductor made of copper or a copper alloy having a residual resistivity $\rho_0$ of $5\times10^{-9}$ Ω·m or more.

According to another aspect of the present invention, there is provided a current lead, for electrically connecting a superconducting device cooled to a low temperature to a power supply kept at room temperature and cooled by a vapor obtained by evaporating liquid helium for cooling a superconducting device, comprising: a conductor in which a current flows; a gas circulating tube which is arranged to surround the conductor and in which cooling helium vapor is circulated; a liquid nitrogen anchor portion which is formed at a portion of the current lead and in which the conductor is cooled by liquid nitrogen; and a bypass tube which is arranged at a position corresponding to the liquid nitrogen anchor portion to be separated from the conductor and which is connected to the gas circulating tube to bypass the helium vapor.

According to still another aspect of the present invention, there is provided a current lead, for electrically connecting a superconducting device cooled to a low temperature to a power source kept at room temperature, and cooled by a vapor obtained by evaporating liquid helium for cooling a superconducting device, comprising: a conductor in which a current flows; a gas circulating tube which is arranged to surround the conductor and in which cooling helium vapor is circulated; a liquid nitrogen anchor portion which is formed at a portion of the current lead and in which the conductor is cooled by liquid nitrogen; and heat insulating means, arranged at a portion corresponding to the liquid nitrogen anchor portion in the gas circulating tube, for thermally insulating helium vapor circulated in the anchor portion from cooling liquid nitrogen.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
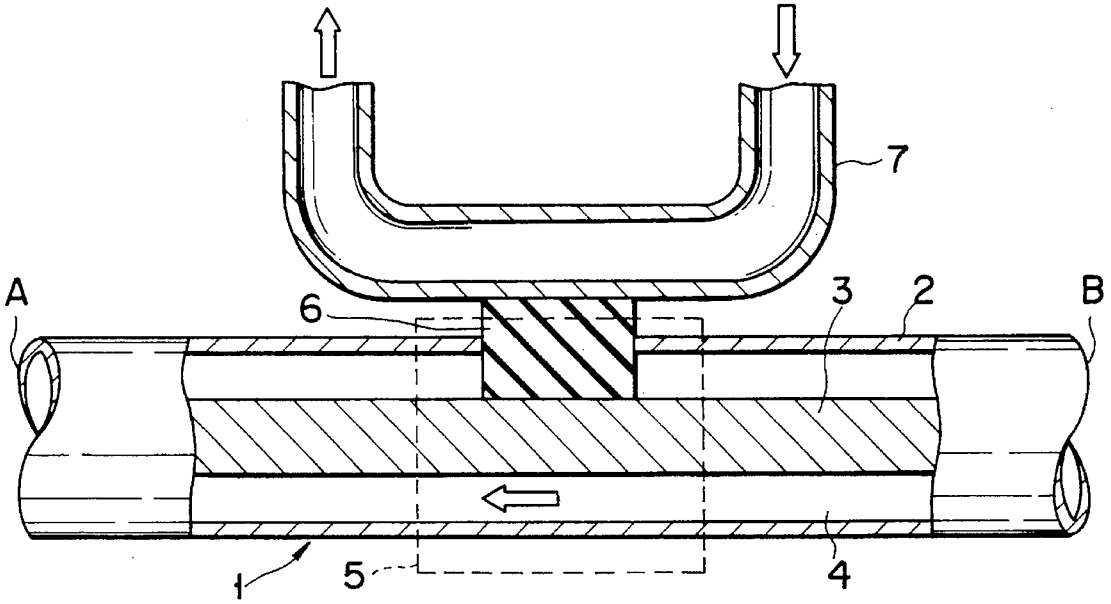
FIG. 1 (PRIOR ART)
FIGS. 1 and 2 are sectional views showing conventional gas-cooling type current leads.
Figure 2:
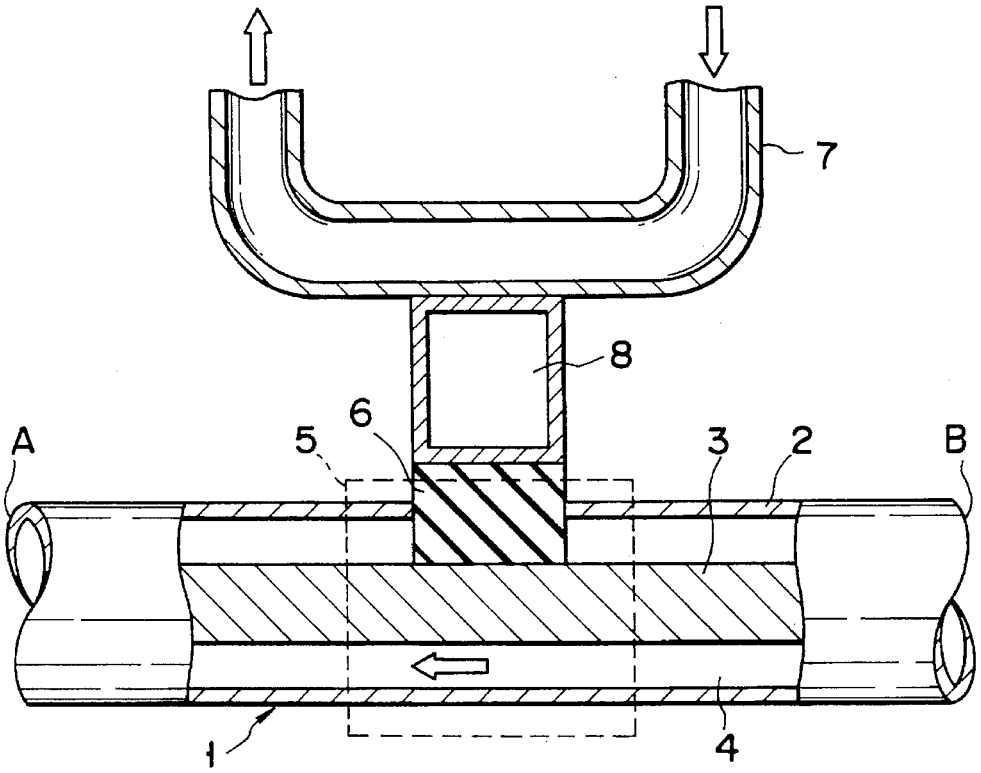
FIG. 2 (PRIOR ART)

The first embodiment of the present invention will be described below.

In this embodiment, a conductor of a current lead for electrically connecting a superconducting device cooled to a very low temperature to a power supply kept at room temperature and for magnetizing the superconducting magnet to a persistent mode and for demagnetizing the superconducting magnet from the persistent mode is made of copper or a copper alloy having a residual resistivity $\rho_0$ of $5\times10^{-9}$ Ω·m or more.

Although the residual resistivity of pure copper is as low as, e.g., about $1\times10^{-10}$ Ω·m, when other elements are added to pure copper, the residual resistivity of copper is increased. When copper or a copper alloy containing an alloy element or an impurity element to have a residual resistivity of $5\times10^{-9}$ Ω·m or more is used as the current lead conductor, the volume of the conductor can be larger than that of high-purity copper used as the conductor. In addition, the thermal capacity of the conductor can be large. Therefore, the temperature of the current lead can be kept within a stable range in an ON time while thermal penetration to a very-low-temperature portion is suppressed to be low in an OFF time.

A reason for obtaining the above effect will be described below.

An amount of thermal penetration Q to the low-temperature side in an OFF time can be given by equation (1):

$$Q=\frac{A}{L}\int_{Tc}^{Th}\lambda dT \tag{1}$$

where A is the sectional area of the conductor of the current lead; L, the entire length of the conductor; λ, the thermal conductivity of the conductor; and Th and Tc, temperatures of the high- and low-temperature sides, respectively. According to equation (1), as described above, it is understood that the thermal penetration Q can be suppressed to be low by extremely decreasing the value A/L. In addition, the thermal conduction Q can be decreased by decreasing the value λ.

Assuming that the resistivity of the conductor of the current lead is represented by ρ, the thermal conductivity thereof is represented by λ, and the temperature thereof is represented by T, equation (2) can be obtained by the Wiedemann-Frantz rule:

$$\rho \cdot \lambda = L_0 T \tag{2}$$

(where $L_0$ is Lorentz's number: $2.45\times10^{-8}$ W·Ω/K$^2$)

Therefore, when the temperature T is constant, the thermal conductivity λ is in inverse proportion to the resistivity ρ.

According to equations (2) and (1), it is understood to obtain the following effect. When copper or a copper alloy having a residual resistivity higher than that of high-purity copper is used as the conductor of the current lead, the value λ in equation (1) is decreased. Therefore, if the valve L can be slightly changed, the value A can be increased in a constant amount of thermal penetration.

when a rated current is supplied to the current lead in a stationary state, the equation (3) is satisfied:

$$\frac{d}{dX}\left(\lambda A \frac{dT}{dX}\right) + \frac{\rho I^2}{A} = 0 \tag{3}$$

In equation (3), it is assumed that amounts of thermal penetration are equal to each other in cases wherein high-purity copper is used as the current lead conductor and wherein copper or a copper alloy having a large residual resistivity is used. In these cases, the values λA and ρ/A are equal to each other according to equations (1) and (2). In this case, the value of ∫λdT of high purity copper is, for example, a times (a: constant) larger than that of the low purity copper. However, it is assumed that thermal conductivity (function of temperature) of high purity copper is a times larger than that of the low purity copper.

Therefore, according to equation (3), in both the cases, the current lead conductors to which a rated current is supplied in a stationary state have the same temperature distribution. However, as described above, when copper or a copper alloy having a large residual resistivity is used as the current lead conductor, the sectional area A can be increased even when the current lead conductors have the same amount of thermal penetration as described above. Therefore, the thermal capacity of the current lead conductor can be increased. In short-time electric conduction exemplified such that the superconducting magnet is magnetized to a persistent current mode or demagnetized from the persistent current mode, an increase in temperature can be further decreased compared with that of the stationary state. The temperature of the current lead conductor can be stably kept within a constant range. In this case, a cooling gas for holding the thermal stability of the current lead conductor in an ON time is not necessarily required. Even when a cooling gas is used, it is auxiliary. However, when the current lead conductor is cooled by the cooling gas, the thermal stability of the conductor in an ON time can be further improved.

The current lead conductor according to this embodiment is made of copper or a copper alloy having a residual resistivity of $5\times10^{-9}$ Ω·m or more, as described above, in order to obtain low thermal penetration and thermal stability of the conductor in an ON time. As the copper or copper alloy, phosphorus-deoxidized copper (residual resistivity of $5\times10^{-9}$ Ω·m), brass (residual resistivity of 2 to $5\times10^{-8}$ Ω·m), cupronickel (residual resistivity of 2 to $40\times10^{-8}$ Ω·m), or bronze (residual resistivity of 6 to $16\times10^{-8}$ Ω·m) is used.

A superconducting magnet device using a current lead according to this embodiment will be described below with reference to FIGS. 3 to 6.

Figure 3:
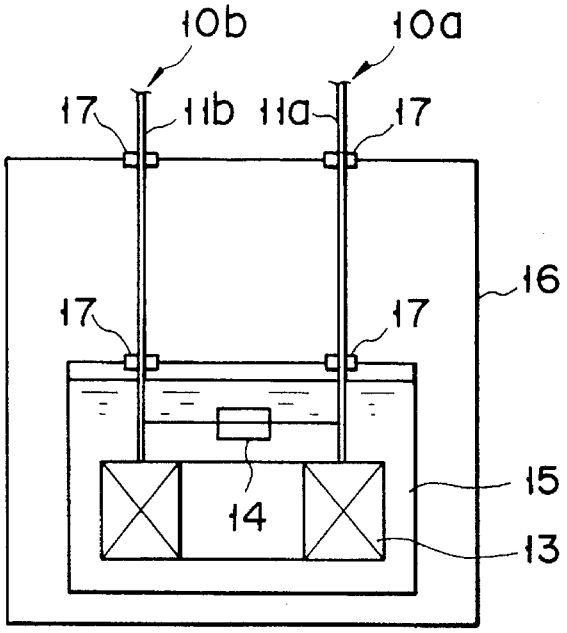
FIGS. 3 to 6 are views showing superconducting magnet devices using current leads according to the first embodiment of the present invention.

In a device shown in FIG. 3, a superconducting magnet 13 is arranged in a helium tank 15, and the superconducting magnet 13 cooled to a very low temperature by liquid helium in the helium tank 15 and a supply (not shown) kept at room temperature are connected to each other by current leads 10*a* and 10*b*. The current leads 10*a* and 10*b* are constituted by conductors 11*a* and 11*b* made of copper or a copper alloy having a residual resistivity of $5\times10^{-9}$ Ω·m or more. In a helium tank 15, a persistent current switch 14, for connecting the conductor 11*a* to the conductor 11*b*, cooled by the liquid helium is arranged. The persistent current switch 14 magnetizes the superconducting magnet to a persistent current mode and demagnetizes the superconducting magnet from the persistent current mode. The helium tank 15 is arranged in a vacuum housing 16. Both of the conductors 11*a* and 11*b* are insulated by insulating members 17 at leading portions of the housing 16 and the helium tank 15. Since the conductors 11*a* and 11*b* are made of copper or a copper alloy having a residual resistivity of $5\times10^{-9}$ Ω·m or more, even when a cooling means for cooling the current lead conductor is not specially arranged, the thermal stability of the conductor in an ON time can be assured.

Figure 4:
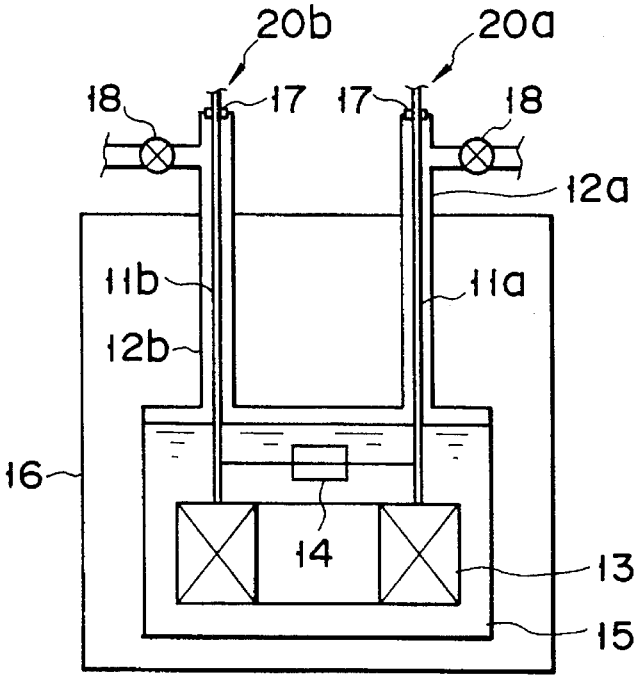

Although a device shown in FIG. 4 has the same basic structure as that of the device in FIG. 3, current leads 20*a* and 20*b* connect a superconducting magnet 13 to a power supply. The current lead 20*a* is constituted by the conductor 11*a* and a cooling helium gas tube 12*a*, and the current lead 20*b* is constituted by the conductor 11*b* and a tube 12*b*, respectively. A valve 18 for adjusting a flow rate of cooling helium gas is arranged in each of the tubes 12*a* and 12*b*. In this case, helium gas evaporated from the helium tank 15 is circulated in the tubes 12*a* and 12*b* to cool the conductors 11*a* and 11*b*. Even when the temperatures of the conductors 11*a* and 11*b* are increased outside a predetermined range, the temperatures can be reliably decreased, thereby further improving the thermal stability of the conductors. Note that, in the leading-out portions of the conductors 11*a* and 11*b* to a room-temperature portion, the conductors 11*a* and 11*b* are insulated from the tubes 12*a* and 12*b* by insulating members 17, respectively.

Figure 5:
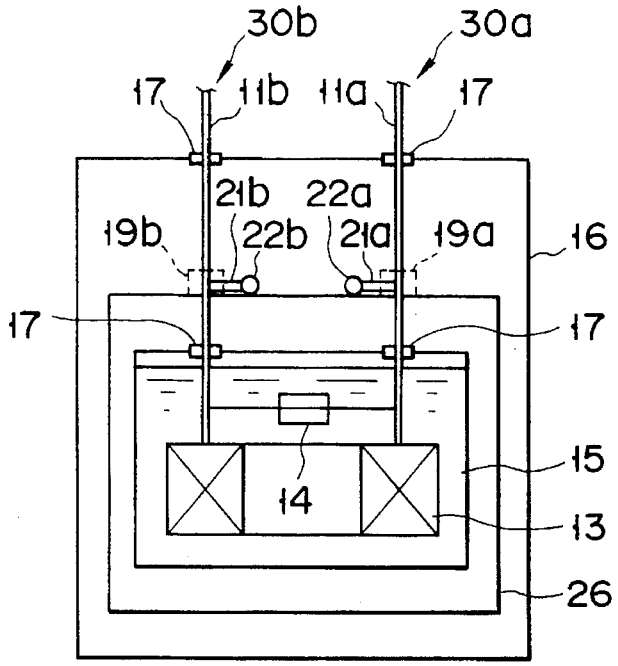

A device shown in FIG. 5 is obtained as follows. A housing 26 is arranged inside the housing 16 of the device in FIG. 3, the housings 26 and 16 are evacuated, and liquid-nitride anchor portions 19*a* and 19*b* are arranged in the leading-out portions of the conductors 11*a* and 11*b* of the housing 26. That is, in this device, current leads 30*a* and 30*b* for connecting the superconducting magnet 13 to the power supply are constituted by the conductors 11*a* and 11*b* and the liquid-nitrogen anchor portions 19*a* and 19*b*, respectively. The liquid-nitrogen anchor portions 19*a* and 19*b* are arranged to control an amount of thermal penetration to the low-temperature side and cooled by liquid nitrogen circulated in liquid-nitrogen circulation pipes 21*a* and 21*b* through thermal-conducting insulating members 22*a* and 22*b*, respectively.

A device in FIG. 6 can be obtained as follows. As in FIG. 5, the housing 26 is arranged inside the housing 16, and the liquid-nitride anchor portions 19*a* and 19*b* are arranged in the leading-out portions of the conductors 11*a* and 11*b* of the housing 26. In addition, as in FIG. 4, the conductors 11*a* and 11*b* are arranged in the cooling helium gas tubes 12*a* and 12*b*, respectively. That is, in the device in FIG. 6, current leads 40*a* and 40*b* connect the superconducting magnet 13 to the power supply. The current lead 40*a* is constituted by the conductor 11*a*, the tube 12*a*, and the liquid-nitrogen anchor portion 19*a*, and the current leads 40*b* is constituted by the conductor 11*b*, the tube 12*b*, and the liquid-nitrogen anchor portion 19*b*. The liquid-nitrogen anchor portions 19*a* and 19*b*, as in FIG. 5, are arranged to control an amount of thermal penetration to the low-temperature side and cooled by liquid nitrogen circulated in the liquid-nitrogen circulation pipes 21*a* and 21*b* through the thermal-conducting insulating members 22*a* and 22*b*, respectively. Helium gas evaporated from the helium tank 15 is circulated in the tubes 12*a* and 12*b* to cool the conductors 11*a* and 11*b*. As in the device of FIG. 4, when cooling helium gas is circulated in the tubes 12*a* and 12*b*, a valve 18 for adjusting a flow rate of the cooling helium gas is arranged in each of the tubes 12*a* and 12*b*.

Figure 7:
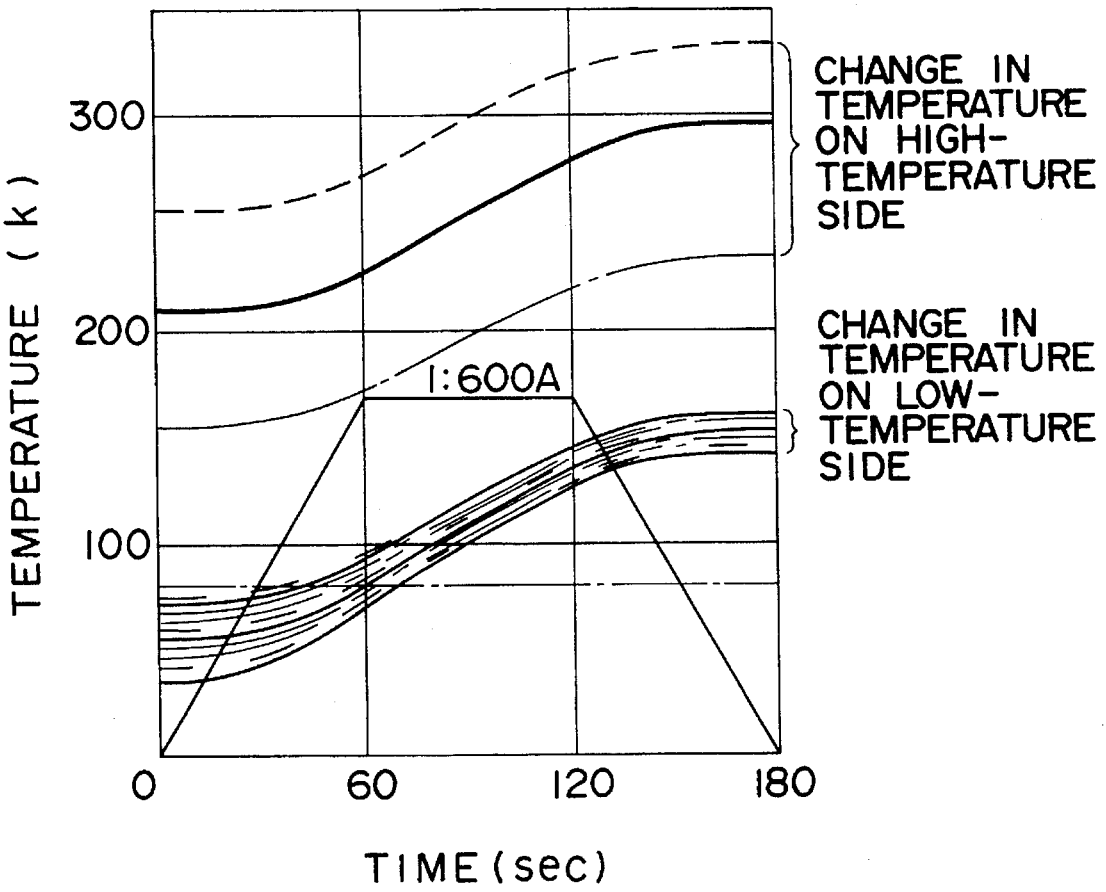
FIG. 7 is a graph showing a change in temperature at each part of the current lead when the device showing in FIG. 3 is driven.

A thermal distribution of current lead conductors obtained by numerical analysis will be described below. In this case, the result obtained from the device is shown in FIG. 7. Brass having a sectional area of 89 $mm^2$ is used as the current lead conductors 11*a* and 11*b*, the distance from a room-temperature end to the center of the liquid-nitrogen anchor portions 19*a* and 19*b* is set to be 500 mm, and the distance from the center of the liquid-nitrogen anchor portions to the superconducting magnet 13 is set to be 1,000 mm. In this case, the thermal distribution of the current lead conductors 11*a* and 11*b* in a process for magnetizing the superconducting magnet 13 to a persistent current mode of a rated current of 600 A was calculated. The result is shown in FIG. 5. As shown in FIG. 5, the maximum temperature in an ON time was about 320K. Therefore, it was shown that the current lead conductor had a small increase in temperature and good thermal stability.

Figure 6:
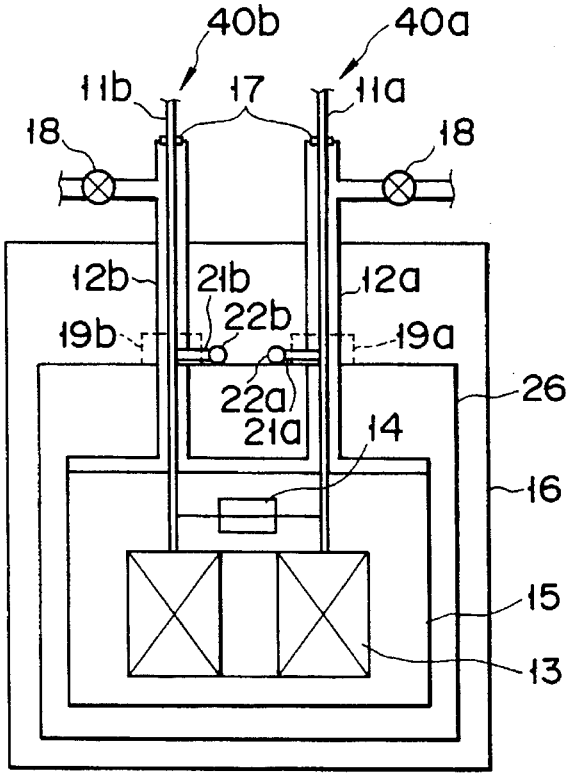

Note that, when another copper or another copper alloy such as cupronickel or phosphor bronze having a residual resistivity of $5\times10^{-9}$ Ω·m or more is used, or when the devices in FIGS. 3, 4, and 6 are used, the same result as described above can be obtained.

The second embodiment of the present invention will be described below. In this embodiment, a liquid-nitrogen anchor portion is featured.

Figure 8:
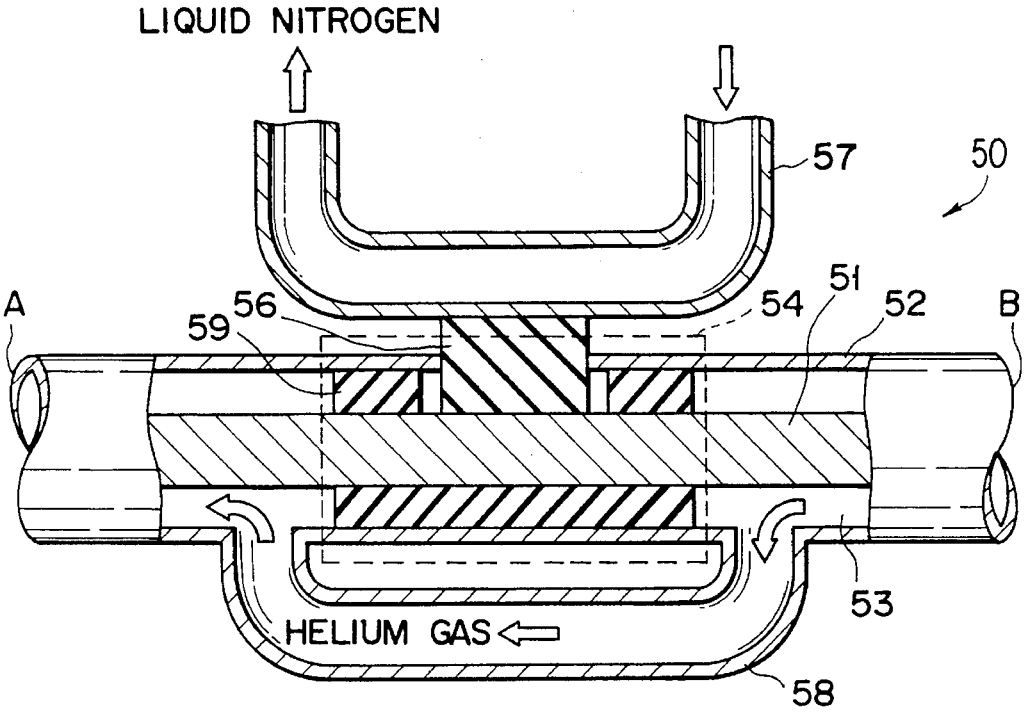
FIG. 8 is a sectional view showing a current lead according to the second embodiment of the present invention.

FIG. 8 is a sectional view showing a current lead according to this embodiment. A current lead 50 includes a cooling tube 52, a conductor 51 arranged therein, and a liquid-nitrogen anchor portion 54, and a cooling helium gas path 53 is formed between the conductor 51 and the cooling tube 52. In the liquid-nitride anchor portion 54, a liquid-nitrogen tube 57 is connected to the conductor 51 through a cooling member 56 made of an electric insulator, and the conductor 51 is cooled by liquid nitrogen circulated in the tube 57. The A and B sides of the current lead are connected to a room-temperature portion and a very-low-temperature portion, respectively, and the cooling helium gas flows from the B side to the A side in the path 53. In this case, the cooling member 56 has a function of cooling the conductor 51 and a function of insulating the conductor 51 from the liquid-nitrogen tube 57.

The cooling helium gas path 53 is connected to a bypass tube 58 arranged to be separated from the cooling tube 52 in the liquid-nitrogen anchor portion 54. Since the path 53 is sealed by an electric insulating member 59, helium gas is not supplied to the anchor portion 54, and all the helium gas is bypassed to the bypass tube 58.

with the above arrangement, since the bypass tube 58 is separated from the cooling tube 52, heat exchange among cooling helium gas, the liquid-nitrogen tube 57, and liquid nitrogen flowing therethrough is extremely suppressed, freezing of the liquid nitrogen can be avoided.

Figure 9:
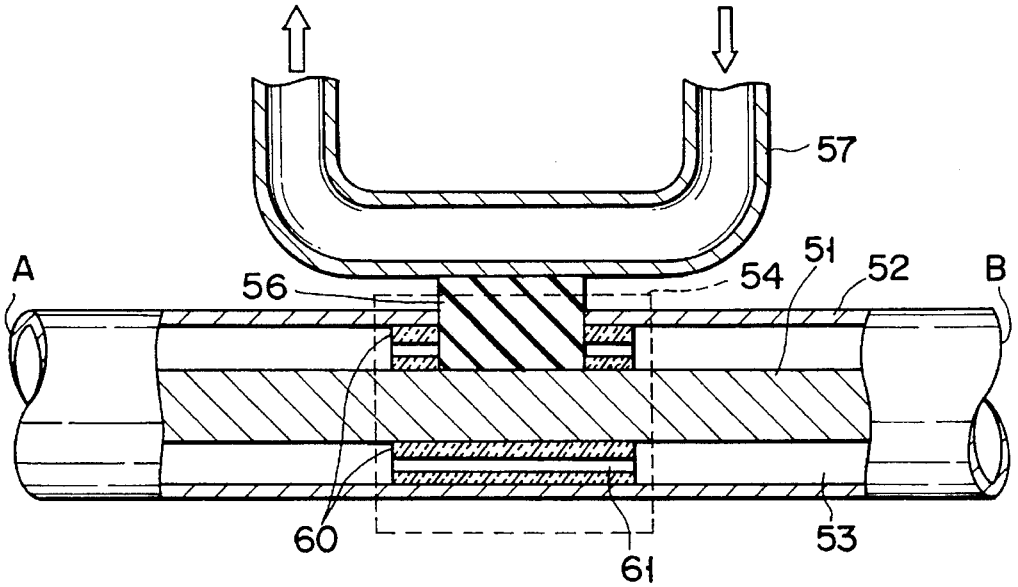
FIG. 9 is a sectional view showing another current lead according to the second embodiment of the present invention.

FIG. 9 is a sectional view showing another current lead according to this embodiment. The current lead has a structure which is basically similar to that of the current lead in FIG. 8. The same reference numerals as in FIG. 8 denote the same parts in FIG. 9, and a detailed description thereof will be omitted. In this current lead, the helium gas path 53 in the liquid nitrogen anchor portion 54 is sealed by a heat insulating member 60 having an electric insulating property, and a hole 61 is formed in the heat insulating member 60 along the path 53. In the anchor portion 54, cooling helium gas flows through the hole 61. The heat insulating member is made of a material such as FRP (fiber reinforced plastics), polytetrafluoroethylene, or a heat-insulating refractory material having a low thermal conductivity.

With the above structure, since the heat insulating member 60 is arranged in the liquid nitrogen anchor portion 54, heat exchange among helium gas circulated in the hole 61 formed in the heat insulating member 60, the liquid nitrogen tube 57, and liquid nitrogen flowing through the tube 57 is extremely suppressed, and freezing of the liquid nitrogen can be avoided, as in the current lead in FIG. 8.

In these current leads, copper or a copper alloy having a residual resistivity of $5\times10^{-9}$ Ω·m or more as in the first embodiment may be used as a material for the conductor 51, or a conventional conductor made of high-purity copper may be used.

Figure 10:
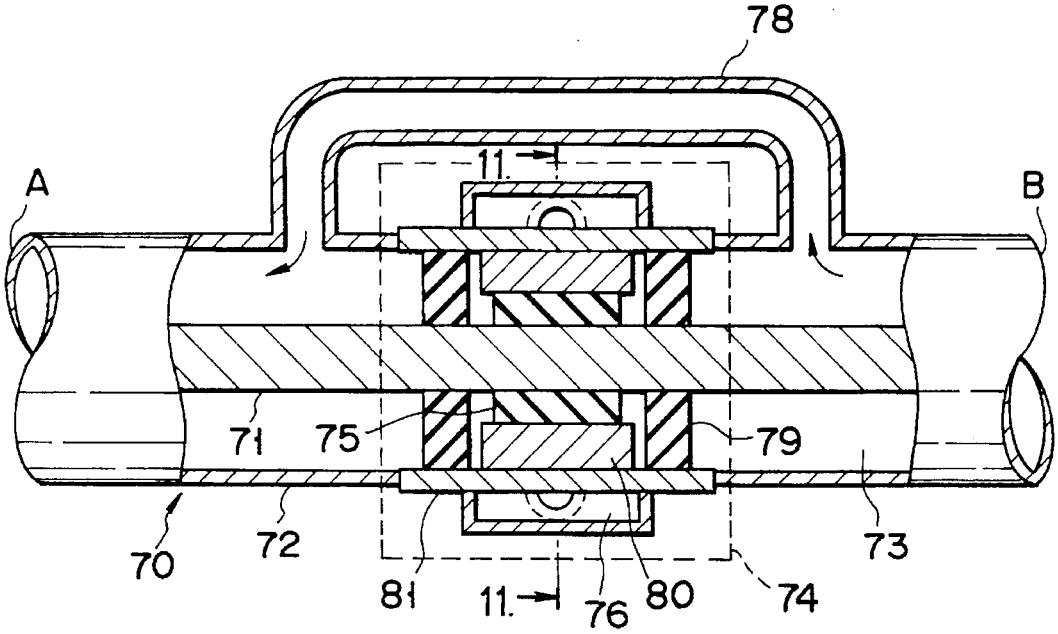
FIG. 10 is a sectional view showing still another current lead according to the second embodiment of the present invention.
Figure 11:
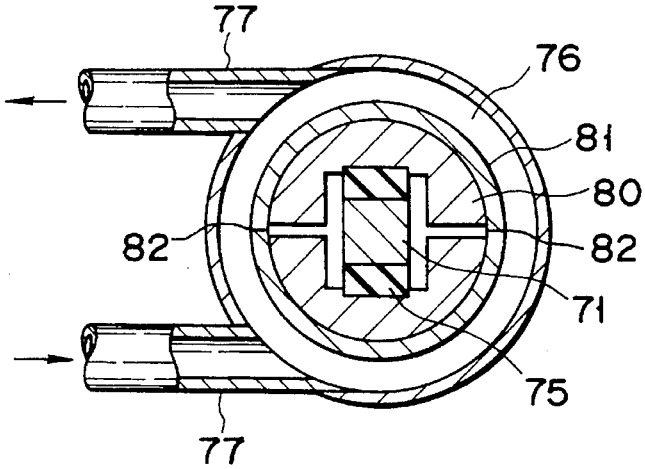
FIG. 11 is a longitudinal sectional view showing the current lead in FIG. 10.

FIG. 10 is a cross-sectional view showing still another current lead having a bypass tube, as in FIG. 8. FIG. 11 is a longitudinal sectional view showing the current lead along a line 11—11 in FIG. 10. A current lead 70 includes a cooling tube 72, a conductor 71 formed in the tube 72, and a liquid nitrogen anchor portion 74. A cooling helium gas path 73 is formed between the conductor 71 and the cooling tube 72.

In the liquid nitrogen anchor portion 74, a cooling member 81 having good thermal conductivity is formed around the cooling tube 72, and a liquid nitrogen cooling tube 76 is formed around the cooling member 81. The cooling tube 76 is connected to a liquid nitrogen supply tube 77, and liquid nitrogen is supplied to the cooling tube 76 through the supply tube 77. An intermediate metal member 80 and an electric insulating member 75 are interposed between the cooling member 81 and the conductor 71, and the conductor 71 is cooled by liquid nitrogen circulated in the liquid nitrogen cooling tube 76. Note that the A and B sides of the current lead are connected to a room-temperature portion and a very-low-temperature portion, respectively, and the cooling helium flows from the B side to the A side in the path 73.

The cooling helium gas path 73 is connected to a bypass 78 arranged to be separated from the cooling tube 72 in the liquid nitrogen anchor portion 74. In the anchor portion 74, the path 73 is sealed by an electric insulating member 79. Therefore, helium gas does not flow in the anchor portion 74, but all the helium gas is bypassed to the bypass tube 78.

The cooling member 81 is welded at a bonding portion 82, and the conductor 71, the electric insulating member 75, and the intermediate metal member 80 are fixed by a force generated by shrinkage after welding.

However, since welding conditions such as the dimensions of the members, a welding rate, and a welding atmosphere vary, the force generated upon thermal shrinkage is possibly changed. Therefore, these members may not be fixed by a uniform pressure (surface pressure). In this case, cooling efficiency is degraded. In addition, the electric insulating member 75 may be broken by heat generated upon welding.

Figure 12:
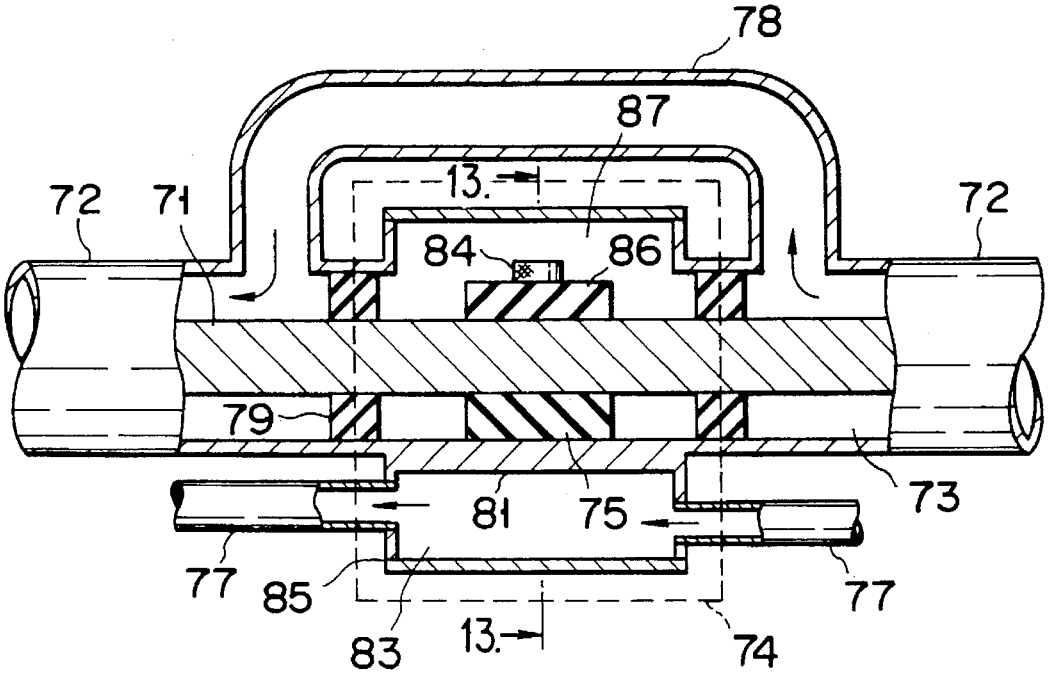
FIG. 12 is a sectional view showing an improved modification of the current lead shown in FIGS. 10 and 11.
Figure 13:
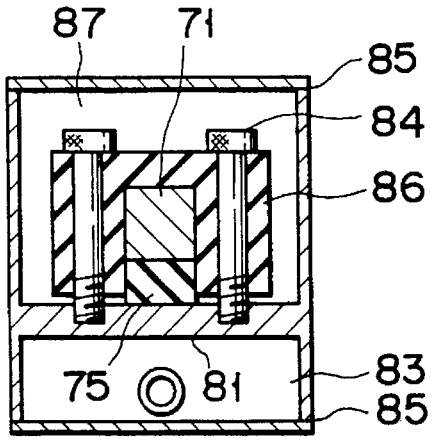
FIG. 13 is a longitudinal sectional view showing the current lead shown in FIG. 12.

FIG. 12 is a cross-sectional view showing an example of a current lead capable of solving the above drawbacks, and FIG. 13 is a longitudinal sectional view showing the current lead along a line 13—13 in FIG. 12. In this current lead, a box 87 is arranged in the liquid nitrogen anchor portion 74, and the cooling member 81 defines the bottom surface of the box 87. A liquid nitrogen vessel 83 is arranged below the cooling member 81, the liquid nitrogen supply tube 77 is connected to the vessel 83, and liquid nitrogen is supplied to the vessel 83 through the supply tube 77. The electric insulating member 75 is interposed between the conductor 71 and the cooling member 81, and the conductor 71 is cooled by liquid nitrogen through the cooling member 81 and the electric insulating member 75. The conductor 71 and the electric insulating member 75 are surrounded by a mounting member 86 made of an electric insulator, and the conductor 71 and the electric insulating member 75 are mounted on the cooling member 81 by the mounting member 86 and bolts 84. In this case, since a pressure is added to the conductor 71 and the electric insulating member 75 by a tightening force of the bolts 84, the tightening force can be adjusted, and these members can be fixed by a uniform pressure (surface pressure). In addition, since welding portions 85 are separated from the electric insulating member 75, the electric insulating member 75 does not receive an influence of heat upon welding. Note that the above pressure applying member can also be effectively applied to a current lead having no bypass tube.

Figure 14:
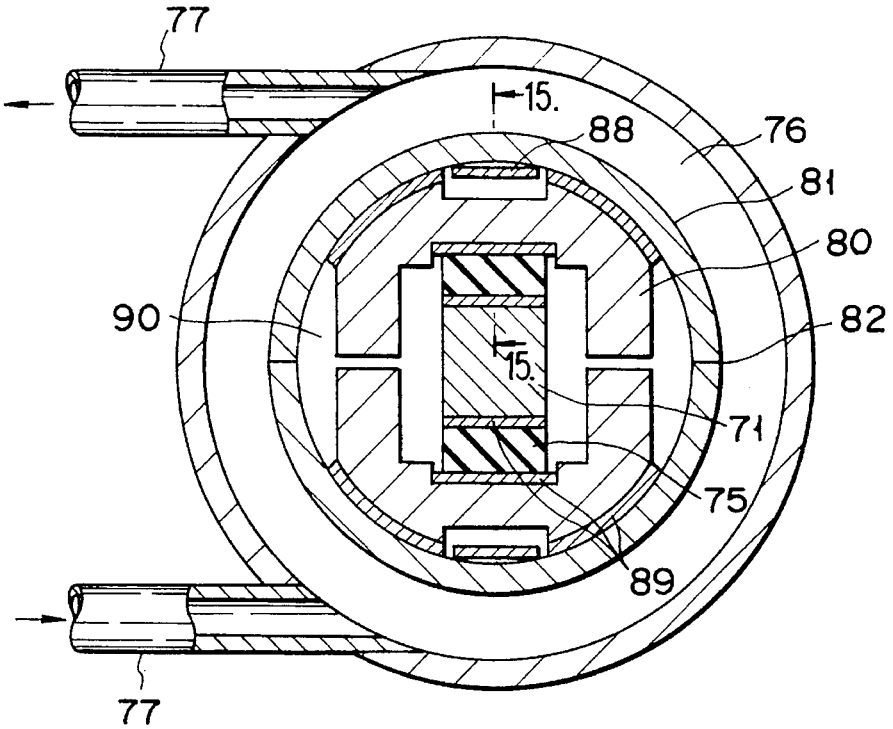
FIG. 14 is a longitudinal sectional view showing another improved modification of the current lead shown in FIGS. 10 and 11.
Figure 15:
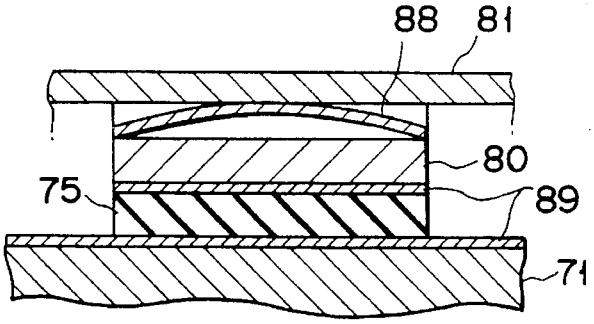
FIG. 15 is a cross-sectional view showing the current lead shown in FIG. 14.

FIG. 14 is a longitudinal sectional view showing another example of a current lead capable of improving the drawbacks of the current lead in FIGS. 10 and 11, and FIG. 15 is a cross-sectional view showing the current lead along a line 15—15 in FIG. 14. In this circuit lead, in order to uniform a surface pressure of the heat conducting surface of the cooling member 81 in the current lead shown in FIGS. 10 and 11, a leaf spring 88 serving as a pressure applying member is interposed between the intermediate metal member 80 and the cooling member 81. The conductor 71, the electric insulating member 75, and the intermediate metal member 80 are fixed by the uniform pressure (surface pressure) generated by a force of the leaf spring 88. In order to obtain good thermal contact, a thermal contacting member 89 is formed on the thermal conducting surface. When sufficient thermal contact can be obtained by the force of the spring 88, the thermal contacting member 89 is not required. A space 90 for avoiding a thermal influence upon welding is formed between the intermediate metal member 80 and the bonding portion 82.

Figure 16:
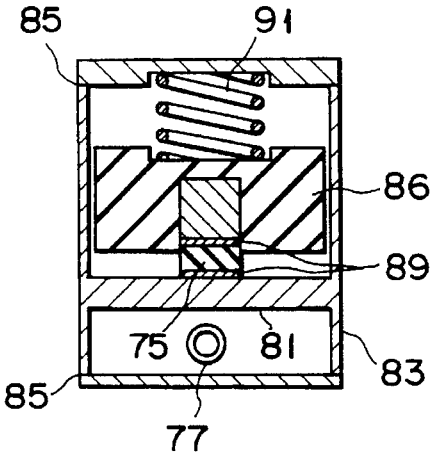
FIG. 16 is a longitudinal sectional view showing still another improved modification of the current lead shown in FIGS. 10 and 11.

In a current lead shown in FIG. 16, a coil spring 91 serving as a pressure applying member is arranged between the box 87 and the mounting member 86 in place of the bolts 84 serving as fixing members in the current lead shown in FIGS. 12 and 13. Thermal contacting members 89 are arranged between the conductor 71 and the electric insulating member 75 and between the member 75 and the cooling member 81. In this current lead, the thermal contacting members 89 are not indispensable members.

Figure 17:
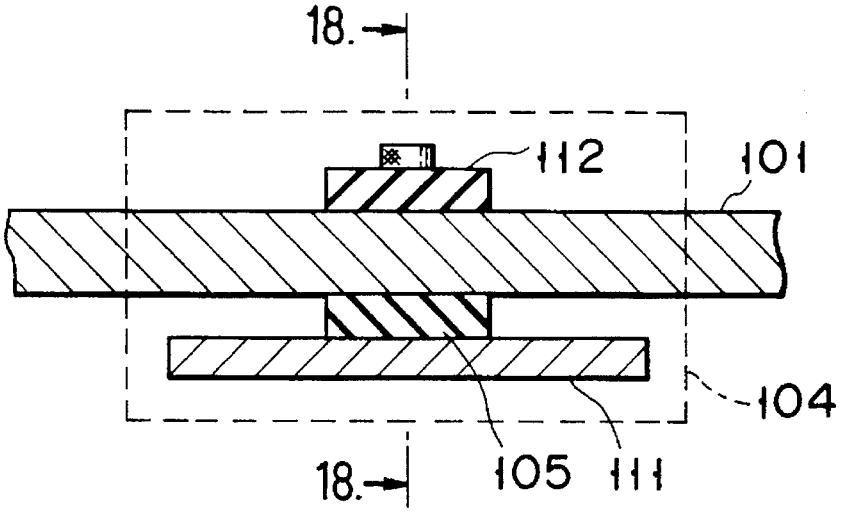
FIG. 17 is a sectional view showing a current lead to which a tube for circulating a helium vapor is not provided but a liquid nitrogen anchor is provided.
Figure 18:
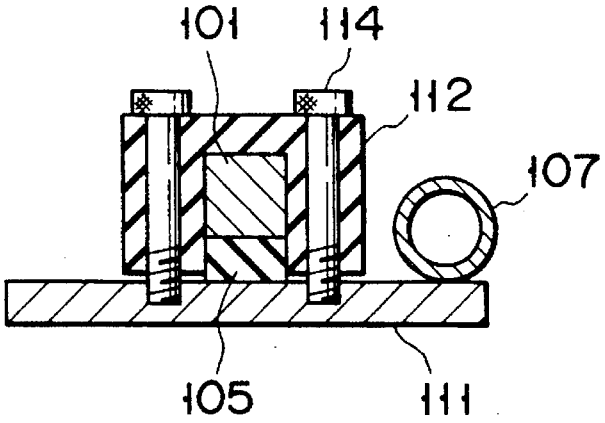
FIG. 18 is a cross-sectional view showing the current lead shown in FIG. 17.

In the current lead shown in FIG. 5 in which the conductor is cooled by liquid helium, the conductor, the electric insulating member, and the cooling member can be fixed as described above. FIG. 17 is a cross-sectional view showing this current lead, and FIG. 18 is a longitudinal sectional view showing the current lead along a line 18—18 in FIG. 17. In this current lead, in a liquid nitrogen anchor portion 104, an electric insulating member 105 is interposed between a conductor 101 and a cooling member 111. A liquid nitrogen circulating tube 107 is formed to be in contact with the cooling member 105, and the conductor is cooled by liquid nitrogen circulated in the circulating tube 107. The conductor 101 and the electric insulating member 105 are surrounded by a mounting member 112 made of an electric insulator, and the conductor 101 and the electric insulating member 105 are fixed on the cooling member 111 by the mounting member 112 and bolts 114.

Note that a bolt or a spring is not only a member which is used as a pressure applying member, and any members which can fix the conductor, the cooling member, and the electric insulating member on the cooling member by a mechanical force may be used.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A current lead for electrically connecting a superconducting magnet of a permanent current mode to a power supply, with the superconducting magnet cooled to an operating temperature of the superconducting magnet and the power supply kept at room temperature, comprising:

a conductor having a residual resistivity $\rho_0$ of not less than $5\times10^{-9}$ Ωm, said conductor consisting essentially of pure copper and at least one of another metal and an impurity element, the amount of the at least one of said another metal and the impurity element being controlled to provide said conductor having said residual resistivity of not less than $5\times10^{-9}$ Ωm;

a liquid nitrogen anchor portion which is formed in a part of said current lead and in which said conductor is cooled by liquid nitrogen;

a gas circulating tube which is formed to surround said conductor and in which helium vapor for cooling said conductor is circulated; and a bypass tube, arranged at a position corresponding to said liquid nitrogen anchor portion to be separated from said conductor and connected to said gas circulating tube, for bypassing said helium vapor.

2. A current lead according to claim 1, wherein said conductor is made of a material selected from the group consisting of phosphor deoxidized copper, brass, cupronickel, and bronze.

3. A current lead according to claim 1, further comprising a heat insulator, arranged at a portion corresponding to said liquid nitrogen anchor portion in said gas circulating tube, for thermally insulating the helium vapor circulated in said anchor portion from cooling liquid nitrogen.

4. A current lead according to claim 1, wherein said liquid nitrogen anchor portion has a liquid nitrogen circulating tube for circulating liquid nitrogen, a cooling member for cooling said conductor by liquid nitrogen circulated in said circulating tube, and an insulating member for insulating said conductor from said liquid nitrogen circulating tube.

5. A current lead according to claim 4, further comprising a pressure applier for applying a pressure between said cooling member and said insulating member and between said insulating member and said conductor.

6. A current lead for electrically connecting a superconducting device cooled to a low temperature to a power supply kept at room temperature, said current lead being cooled by a vapor obtained by evaporating liquid helium for cooling a superconducting device, comprising:

a conductor in which a current flows;

a gas circulating tube which is arranged to surround said conductor and in which cooling helium vapor is circulated;

a liquid nitrogen anchor portion which is formed at a portion of said current lead and in which said conductor is cooled by liquid nitrogen; and a bypass tube which is arranged at a position corresponding to said liquid nitrogen anchor portion to be separated from said conductor and which is connected to said gas circulating tube to bypass said helium vapor.

7. A current lead according to claim 6, wherein said conductor is made of a material selected from the group consisting of phosphor deoxidized copper, brass, cupronickel, and bronze.

8. A current lead according to claim 6, further comprising a heat insulator, arranged at a portion corresponding to said liquid nitrogen anchor portion in said gas circulating tube, for thermally insulating the helium vapor circulated in said anchor portion from cooling liquid nitrogen.

9. A current lead according to claim 6, wherein said liquid nitrogen anchor portion has a liquid nitrogen circulating tube for circulating said liquid nitrogen, a cooling member for cooling said conductor by said liquid nitrogen circulated in said circulating tube, and an insulating member for insulating said conductor from said liquid nitrogen circulating tube.

10. A current lead according to claim 9, further comprising a pressure cupplier for applying a pressure between said cooling member and said insulating member and between said insulating member and said conductor.

11. A current lead according to claim 6, wherein said conductor is formed of copper or a copper alloy having a residual resistivity of not less than $5\times10^{-9}$ Ωm.

* * * * *